US006935683B1

(12) United States Patent
Brown

(10) Patent No.: US 6,935,683 B1
(45) Date of Patent: Aug. 30, 2005

(54) CHAIR ARM MOUNTED COMPUTER ACCESSORY SUPPORT ASSEMBLY

(76) Inventor: Ray H. Brown, 5320 E. Willow Creek Rd., Castle Rock, CO (US) 80104-9769

( * ) Notice: Subject to any disclaimer, the term of this patent is extended or adjusted under 35 U.S.C. 154(b) by 0 days.

(21) Appl. No.: 10/831,664

(22) Filed: Apr. 24, 2004

(51) Int. Cl.[7] ..... A47C 7/62
(52) U.S. Cl. ..... 297/188.2; 297/188.18; 297/153
(58) Field of Search ..... 297/411.23, 188.12, 297/188.14, 153, 188.18; 108/47, 44, 46, 108/97, 98, 157.11, 159.11; 248/918, 309.1, 248/126, 207, 274.1, 316.8, 228.1

(56) References Cited

U.S. PATENT DOCUMENTS 2,797,973 A * 7/1957 Culpepper ..... 108/157.11
3,185,113 A * 5/1965 Nathan et al. ..... 108/47 X
4,575,149 A * 3/1986 Forestal et al. ..... 297/153 X
5,292,173 A 3/1994 Lambert
D374,000 S 9/1996 Wood
D403,312 S 12/1998 O'Brien
5,876,002 A 3/1999 White
D428,418 S 7/2000 Benedict

* cited by examiner

*Primary Examiner*—Anthony D. Barfield
(74) *Attorney, Agent, or Firm*—Lawrence N. Ginsberg

(57) ABSTRACT

A chair arm mounted computer accessory support assembly that includes a support plate and a chair arm engaging assembly. The support plate has an upper surface for supporting a computer accessory and a lower surface for supporting the support plate on an upper surface of a chair arm. The chair arm engaging assembly is securely attachable to the lower surface of said support plate and is operably engageable with lateral surfaces of the chair arm to provide lateral support of the computer accessory support assembly relative to the chair arm. The chair arm engaging assembly includes a pair of side panels securely attachable to the lower surface of said support plate; and fastening means operatively associated with the pair of side panels for securing the pair of side panels on opposing sides of the chair arm.

16 Claims, 3 Drawing Sheets

CHAIR ARM MOUNTED COMPUTER ACCESSORY SUPPORT ASSEMBLY

BACKGROUND OF THE INVENTION

1. Field of the Invention

The present invention relates to computer accessories, and more particularly to a chair mounted computer support assembly.

2. Description of the Related Art

The utilization of computer accessories, such as the use of a mouse or joystick, typically involves positioning such components relative to a computer desk. To maximize the amount of utilizable space at the workstation a sliding platform is typically utilized which is positioned underneath the desktop. Generally, there are inherent arm fatigue issues present with this type of a system.

One attempt to improve upon such a system is disclosed in U.S. Pat. No. 5,876,002, issued to V. C. White et al. The '002 invention includes a support plate which is removably mounted on a desk top, table, or on a drawer extended from the desk or table, in order to extend the surface of the desk top or table and support the mouse pad and mouse in a more accessible location for the mouse user, and provide a support upon which the user's forearm may rest while operating the mouse.

U.S. Pat. No. 5,292,173, issued to D. E. Lambert, discloses a plate structure of a generally L-shaped configuration that includes a first plate portion coplanar with a second plate portion. The first plate portion includes a plurality of first plate portion apertures directed therethrough to receive fasteners for securement to the bottom surface of a chair arm of an associated chair assembly. In this manner, various computer components may be readily oriented relative to the chair assembly in proximity to a user of such components.

U.S. Pat. No. Des. 374,000, issued to D. E. Wood et al, entitled "Chair Mounted Mouse" discloses the use of a mouse pad that connects to an arm chair via a connecting element that tightens to a D-ring element which, in turn, connects to a clamp.

U.S. Pat. No. Des. 403,312, issued to C. M. O'Brien, entitled "Chair-Mounted Mouse Pad Assembly" discloses the use of a mouse pad that appears to be supported by the side support for an arm rest of a chair.

U.S. Pat. No. Des. 428,418, issued to D. J. Benedict, entitled "Arm and Computer Pad Support" discloses the use of a mouse pad that appears to be supported by a bottom surface thereof to the arm of a chair.

Generally, the devices discussed above appear to be fairly complicated in assembly, bulky and in most cases could get in the way of the user's legs and knees.

SUMMARY OF THE INVENTION

In a broad aspect, the present invention is a chair arm mounted computer accessory support assembly that includes a support plate and a chair arm engaging assembly. The support plate has an upper surface for supporting a computer accessory and a lower surface for supporting the support plate on an upper surface of a chair arm. The chair arm engaging assembly is securely attachable to the lower surface of said support plate and is operably engageable with lateral surfaces of the chair arm to provide lateral support of the computer accessory support assembly relative to the chair arm. The chair arm engaging assembly includes a pair of side panels securely attachable to the lower surface of said support plate; and fastening means operatively associated with the pair of side panels for securing the pair of side panels on opposing sides of the chair arm.

The fastening means preferably includes elongated opening fastening elements extending from one side panel to the other side panel for securing the chair arm mounted computer accessory support assembly to a chair arm. The elongated opening fastening elements also serve to function to prevent the support plate from tilting forwardly during use.

Use of the present invention has several advantages over the prior art. It minimizes stress to the wrist and arm by putting the mouse in a more normal work position, thus minimizing the possibility of developing carpal tunnel syndrome. It is relatively inexpensive to manufacture making it readily affordable to the general public. It is compact—easy to carry from one destination to another, for example, in your briefcase. It installs easily and in minutes without any modifications or disfigurement to the chair. The support assembly adapts and installs on most office chairs for left or right handed users. It can easily be moved from chair to chair.

The user can easily relax using the present invention because it enables the user to sit in the chair properly and not hunch over the desk as is often done—which can cause back and shoulder pain by influencing the posture. It has no moveable parts to wear out. It maximizes work space by moving the mouse from the desktop to chair arm. The present invention also provides enhanced convenience for joy stick or game operation by allowing use from the comfort of an arm chair.

DETAILED DESCRIPTION OF THE INVENTION

Figure 1:
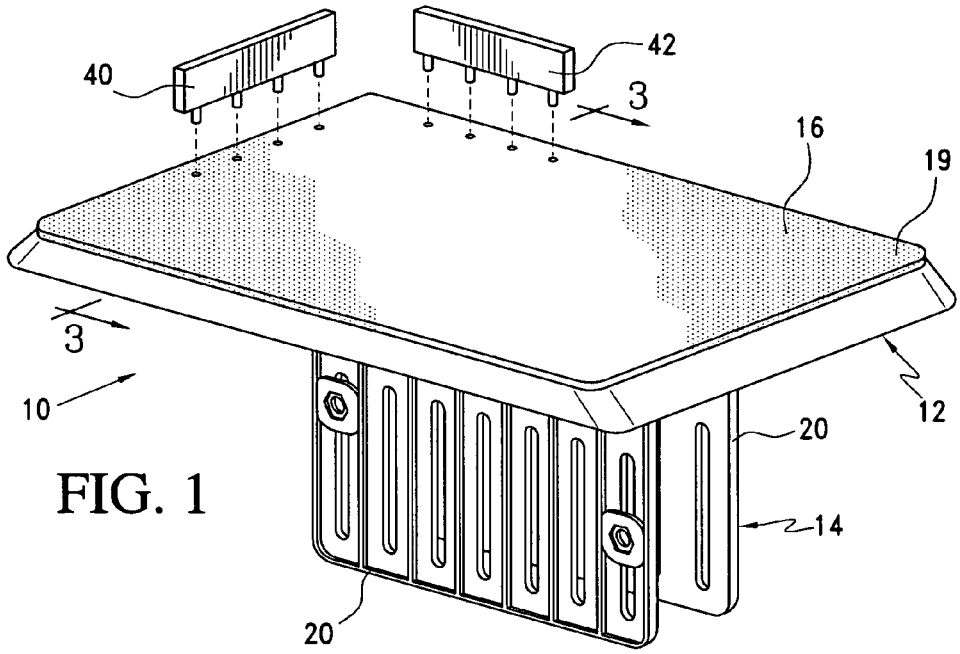
FIG. 1 is a top perspective view of the chair arm mounted computer accessory support assembly of the present invention.
Figure 2:
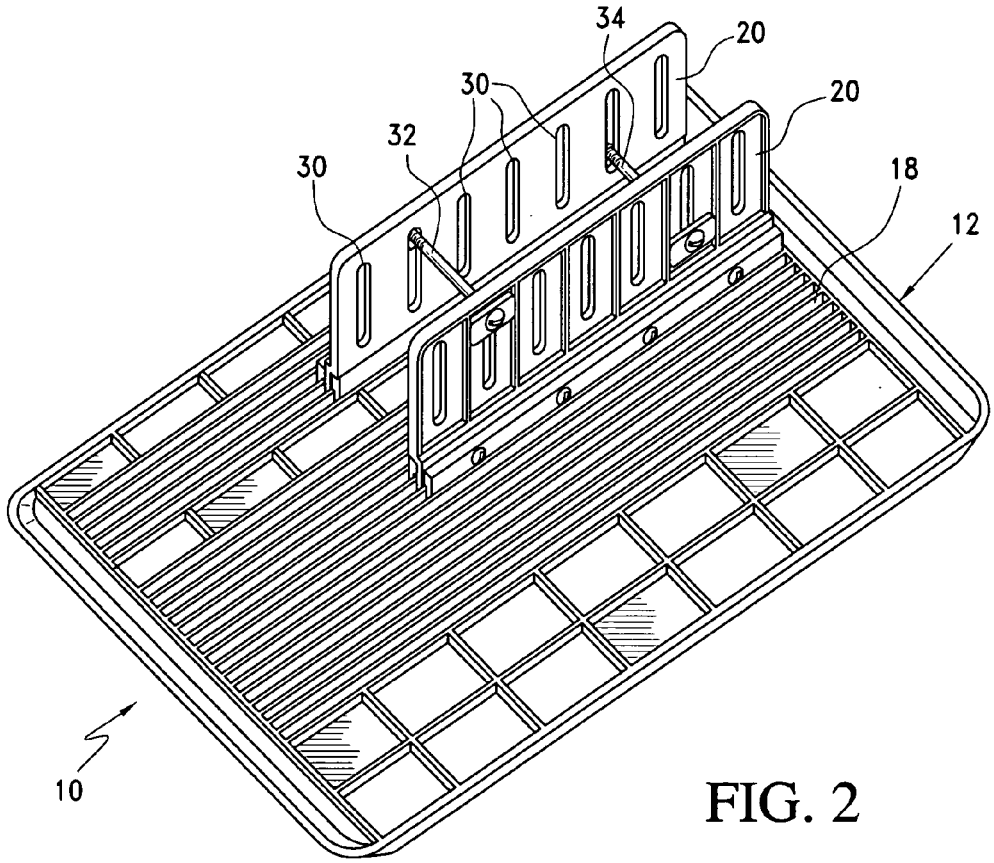
FIG. 2 is a bottom perspective view of the support assembly of FIG. 1.
Figure 3:
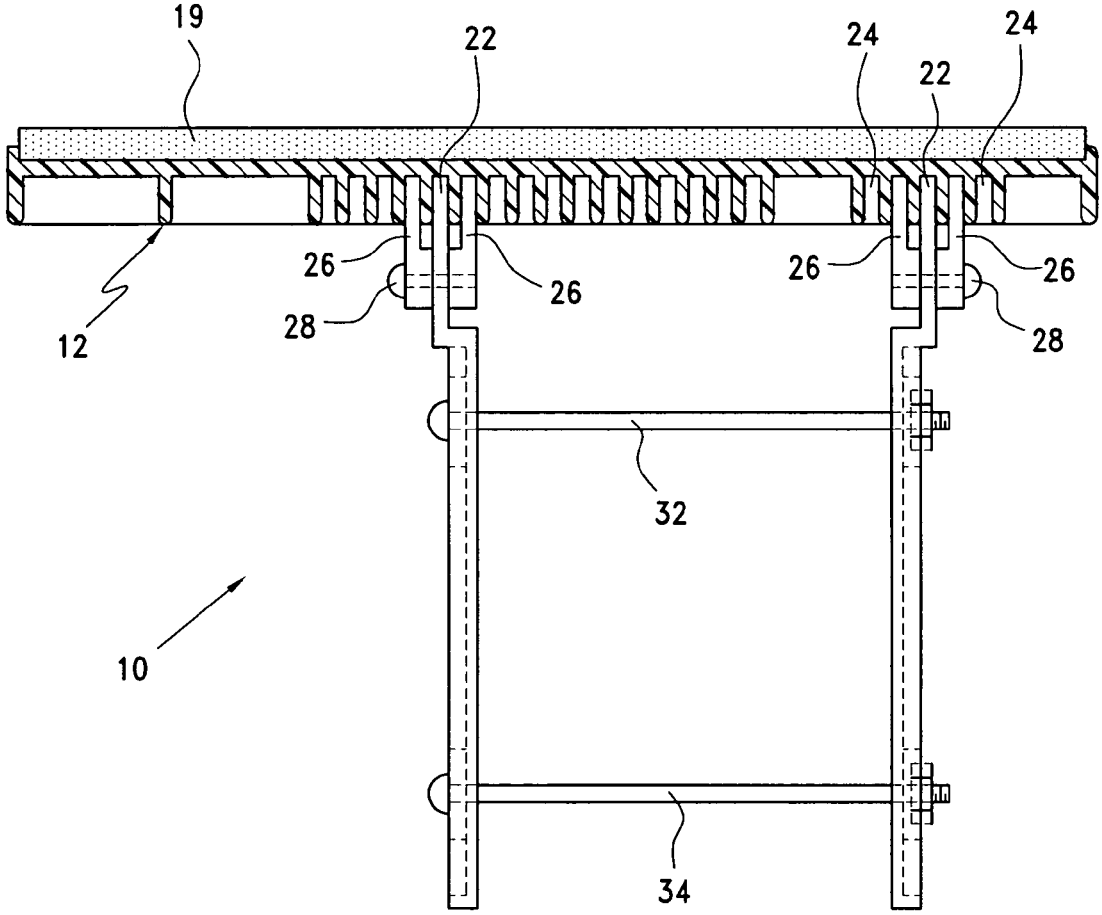
FIG. 3 is a view taken along lines 3—3 of FIG. 1.

Referring now to the drawings and the characters of reference marked thereon, FIGS. 1–3 illustrate a preferred embodiment of the chair arm mounted computer accessory support assembly of the present invention, designated generally as 10. The chair arm mounted computer accessory support assembly 10 includes a support plate, designated generally as 12, and a chair arm engaging assembly, designated generally as 14. The support plate 12 has an upper surface 16 for supporting a computer accessory, such as a mouse, and a lower surface 18 for supporting the support plate on an upper surface of a chair arm. The support plate 12 may include, for example, a mouse pad 19, as shown in these figures. This mousepad 19 may be removable for interchangeability with other mousepads.

The chair arm engaging assembly 14 is securely attachable to the lower surface 18 of the support plate and is operably engageable with lateral surfaces of the chair arm to provide lateral support of the computer accessory support assembly relative to the chair arm. Assembly 14 preferably includes a pair of side panels 20 securely attachable to the lower surface of the support plate 12.

Each side panel 20 preferably includes a longitudinal extension 22. The longitudinal extension 22 fits within bottom surface elongated slots 24 formed in the lower surface of the support plate 12. A pair of opposed elongated clamping elements 26 are positioned to secure each longitudinal extension 22 to its associated support plate 12. Clamping element/longitudinal extension fastening members 30 securely fasten the clamping elements with the longitudinal extensions. A spaced series of fasteners 28 are provided along the length of each support panel 20. Thus, the support panels 20 are adjustable along the length of the support plate. The support panels 20 are also adjustable in their separation to accommodate varying widths of chair arms.

Each support panel 20 includes horizontally spaced, vertically extending elongated openings 30. Elongated opening fastening elements 32, 34 extend from one side panel 20 to the other side panel 20 for securing the chair arm mounted computer accessory support assembly 10 to a chair arm. These elements may comprise carriage-type bolts.

Figure 4:
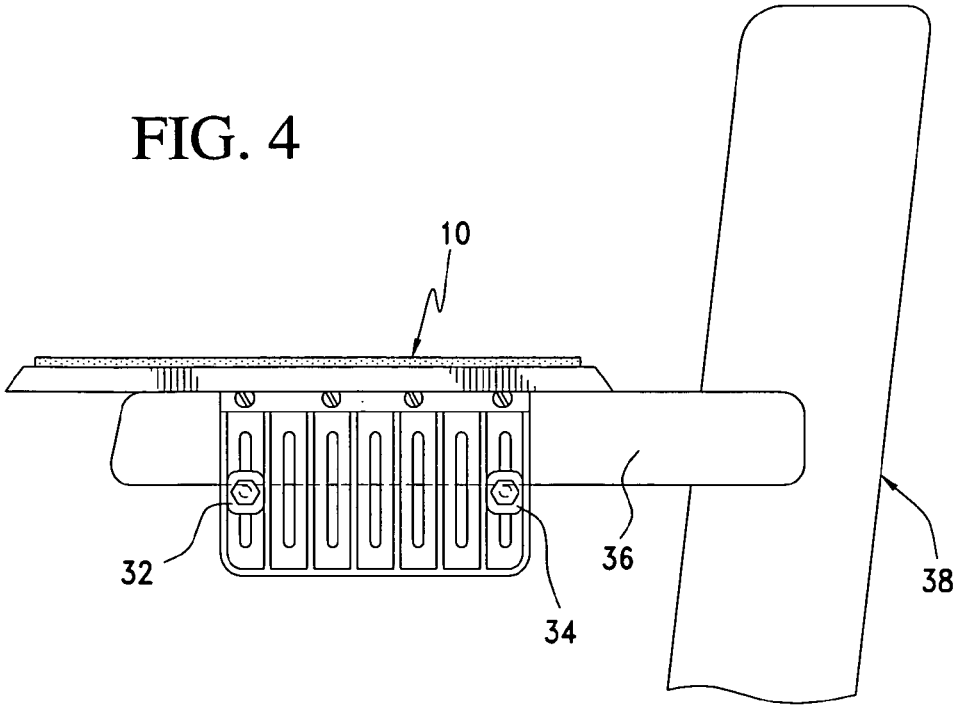
FIG. 4 is a side view showing the utilization of the support assembly with a chair having a straight arm.

Referring now to FIG. 4, the chair arm mounted computer accessory support assembly 10 is shown mounted on an arm 36 of a chair 38. With a chair 38 having a substantially straight arm 36, as shown in this figure, the fastening elements 32, 34 are generally positioned at the same elevation. The chair arm 36 rests on top of them.

Figure 5:
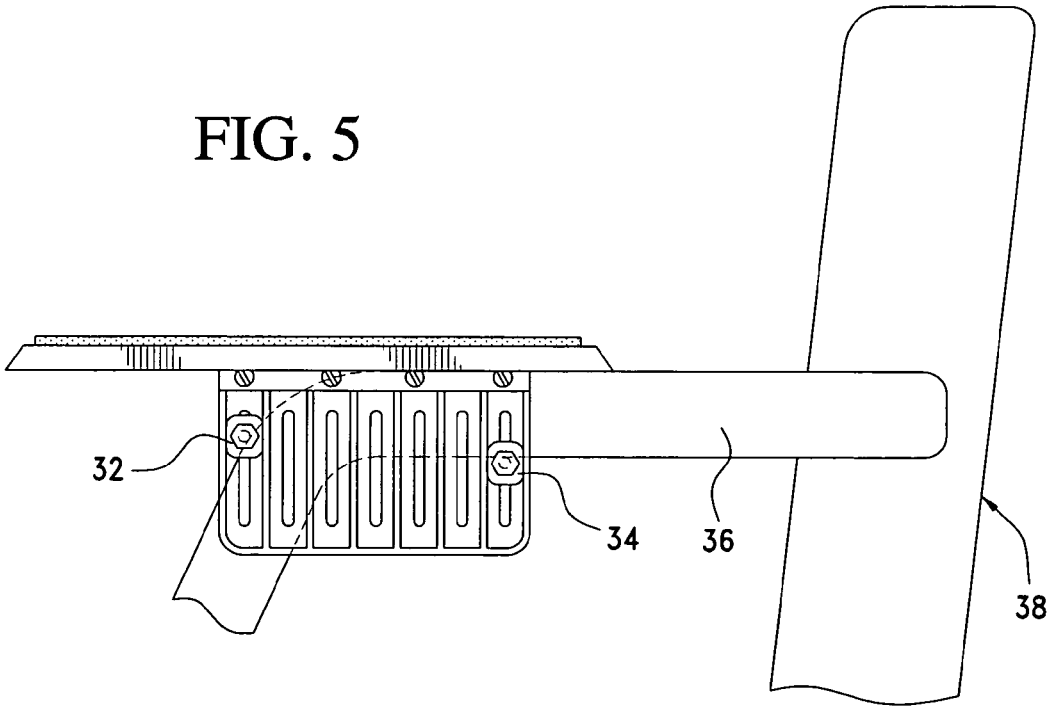
FIG. 5 is a side view showing the utilization of the support assembly with a chair having a curved arm.

However, the fastening elements 32, 34 can be adjusted to accommodate various configurations of arm chairs. For example, referring now to FIG. 5, the front fastening element 32 is raised up so that it secures the upper surface of the forward curved portion of the chair arm 36. The rear fastening element 34 is maintained in a similar position as FIG. 4 so that it supports the lower surface of the chair arm 36. Thus, the support plate 12 is prevented from tilting downward.

In use, both fastening elements, i.e. bolts 32, 34 are adjusted so that they contact the chair arm and are then tightened until they are snug. On some chairs three bolts may work better than two. These screws/bolts can easily be replaceable if they break, substitutes being easily obtainable from a hardware store.

The support plate 12 is preferably substantially rectangular; however other shapes may be utilized as desired. It may include features that prevent mouse movement. For example, it may have a ridge that extends partially or completely around the perimeter of the mouse pad. Or, for example, as shown in FIG. 1, optional removable guard units 40, 42 may be utilized. The guard units 40, 42 can be easily installed or removed as to preference and are adaptable for left hand or right hand use. These plates i.e. guard units, when installed, aid in maintaining the mouse on the pad when relocating or exiting the chair. There are preferably four extruded tabs on the bottom which will match 4 holes in the support plate 12. These may be installed on the front and side edge of the support plate in close proximity to the upper right hand corner or the rear and side edge of the lower left hand corner. These may be preferably located about 1" to 1½" from the corner along the outer edges so that they do not interfere with the radius on the corners of the support plate 12. These are removable or interchangeable so that they are useful for both right hand and left hand users, and can also be removed so that your wrist or arm does not have to lay across them when using a mouse.

Although the present invention has been discussed with application relative to a mouse, other suitable applications can apply. For example, it can be utilized with a joystick or other computer accessories. Further, although the invention can be manufactured with a variety of dimensions it is preferably about 8½×11, a convenient paper size that enables the unit to also be used as a writing platform.

Other embodiments and configurations may be devised without departing from the spirit of the invention and the scope of the appended claims.

What is claimed is:

1. A chair arm mounted computer accessory support assembly, comprising:

a) a support plate having an upper surface for supporting a computer accessory and a lower surface for supporting said support plate on an upper surface of a chair arm; and, b) a chair arm engaging assembly securely attachable to said lower surface of said support plate and operably engageable with lateral surfaces of the chair arm to provide lateral support of the computer accessory support assembly relative to the chair arm, said chair arm engaging assembly, comprising:

a pair of side panels securely attachable to said lower surface of said support plate; and, fastening means operatively associated with said pair of side panels for securing said pair of side panels on opposing sides of the chair arm, each said side panel comprising a longitudinal extension;

wherein said support plate comprises a plurality of elongated slots for cooperative engagement with said longitudinal extensions for adjustably positioning said side panels relative to said support plate.

2. The chair arm mounted computer accessory support assembly of claim 1 wherein said fastening means includes means for preventing said support plate from tilting forwardly during use.

3. The chair arm mounted computer accessory support assembly of claim 1, wherein each of said side panels comprises a plurality of horizontally spaced, vertically extending elongated openings, said fastening means comprising elongated opening fastening elements extending from one side panel to the other side panel for securing the chair arm mounted computer accessory support assembly to a chair arm, said elongated opening fastening elements functioning to prevent the support plate from tilting during use.

4. The chair arm mounted computer accessory support assembly of claim 3 wherein said elongated opening fastening elements comprises a pair of elongated opening fastening elements, a front of said pair being positioned near front ends of said side panels and a rear of said pair being positioned near rear ends of said side panels.

5. The chair arm mounted computer accessory support assembly of claim 3 wherein said front elongated opening fastening element and said rear elongated opening fastening element are positionable at substantially the same elevation to accommodate a substantially straight chair arm.

6. The chair arm mounted computer accessory support assembly of claim 3 wherein said front elongated opening fastening element is positionable at a higher elevation than said rear elongated opening fastening element to accommodate a chair arm that is curved.

7. The chair arm mounted computer accessory support assembly of claim 1 wherein said support plate is substantially rectangular.

8. A chair arm mounted computer accessory support assembly, comprising:

a) a support plate having an upper surface for supporting a computer accessory and a lower surface for supporting said support plate on an upper surface of a chair arm; and, b) a chair arm engaging assembly securely attachable to said lower surface of said support plate and operably engageable with lateral surfaces of the chair arm to provide lateral support of the computer accessory support assembly relative to the chair arm, said chair arm engaging assembly, comprising:

i. a pair of side panels securely attachable to said lower surface of said support plate, each side panel having a plurality of horizontally spaced, vertically extending elongated openings; and;

ii. fastening means operatively associated with said pair of side panels for securing said pair of side panels on opposing sides of the chair arm, said fastening means comprising elongated opening fastening elements extending from one side panel to the other side panel for securing the chair arm mounted computer accessory support assembly to a chair arm, said elongated opening fastening elements functioning to prevent the support plate from tilting during use.

9. A chair arm mounted computer accessory support assembly, comprising:

a) a support plate having an upper surface for supporting a computer accessory and a lower surface for supporting said support plate on an upper surface of a chair arm; and, b) a chair arm engaging assembly securely attachable to said lower surface of said support plate and operably engageable with lateral surfaces of the chair arm to provide lateral support of the computer accessory support assembly relative to the chair arm, said chair arm engaging assembly, comprising:

a pair of side panels securely attachable to said lower surface of said support plate; and, fastening means operatively associated with said pair of side panels for securing said pair of side panels on opposing sides of the chair arm, said fastening means comprising a pair of opposed elongated clamping elements, said side panel comprising a longitudinal extension;

wherein said support plate comprises a plurality of elongated slots cooperatively engageable with said longitudinal extensions for adjustably positioning said side panels relative to said support plate, each clamping element being positioned on an associated side of one said longitudinal extensions.

10. The chair arm mounted computer accessory support assembly of claim 9 wherein said fastening means includes means for preventing said support plate from tilting forwardly during use.

11. The chair arm mounted computer accessory support assembly of claim 9 wherein said elongated opening fastening elements comprises a pair of elongated opening fastening elements, a front of said pair being positioned near front ends of said side panels and a rear of said pair being positioned near rear ends of said side panels.

12. The chair arm mounted computer accessory support assembly of claim 11 wherein said front elongated opening fastening element is positionable at a higher elevation than said rear elongated opening fastening element to accommodate a chair arm that is curved.

13. The chair arm mounted computer accessory support assembly of claim 11, wherein each of said side panels comprises a plurality of horizontally spaced, vertically extending elongated openings, said fastening means comprising elongated opening fastening elements extending from one side panel to the other side panel for securing the chair arm mounted computer accessory support assembly to a chair arm, said elongated opening fastening elements functioning to prevent the support plate from tilting during use.

14. A chair arm mounted computer accessory support assembly, comprising:

a) a support plate having an upper surface for supporting a computer accessory and a lower surface for supporting said support plate on an upper surface of a chair arm; and, b) a chair arm engaging assembly securely attachable to said lower surface of said support plate and operably engageable with lateral surfaces of the chair arm to provide lateral support of the computer accessory support assembly relative to the chair arm, said chair arm engaging assembly, comprising:

a pair of side panels securely attachable to said lower surface of said support plate; and, fastening means operatively associated with said pair of side panels for securing said pair of side panels on opposing sides of the chair arm, said fastening means comprising a pair of opposed elongated clamping elements, said side panel comprising a longitudinal extension;

wherein said support plate comprises a plurality of elongated slots cooperatively engageable with said longitudinal extensions for adjustably positioning said side panels relative to said support plate, each clamping element being positioned on an associated side of one said longitudinal extensions, said fastening means further comprising a plurality of clamping element/longitudinal extension fastening members for securely fastening said clamping elements with said longitudinal extension.

15. The chair arm mounted computer accessory support assembly of claim 14 wherein said elongated opening fastening elements comprises a pair of elongated opening fastening elements, a front of said pair being positioned near front ends of said side panels and a rear of said pair being positioned near rear ends of said side panels.

16. The chair arm mounted computer accessory support assembly of claim 14, wherein each of said side panels comprises a plurality of horizontally spaced, vertically extending elongated openings, said fastening means comprising elongated opening fastening elements extending from one side panel to the other side panel for securing the chair arm mounted computer accessory support assembly to a chair arm, said elongated opening fastening elements functioning to prevent the support plate from tilting during use.

* * * * *